US008517786B2

(12) United States Patent
Musasa et al.

(10) Patent No.: US 8,517,786 B2
(45) Date of Patent: Aug. 27, 2013

(54) METHOD OF PRODUCING A SPARK PLUG

(75) Inventors: Mamoru Musasa, Nagoya (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/989,561

(22) PCT Filed: Apr. 22, 2009

(86) PCT No.: PCT/JP2009/057959
§ 371 (c)(1),
(2), (4) Date: Oct. 25, 2010

(87) PCT Pub. No.: WO2009/131134
PCT Pub. Date: Oct. 29, 2009

(65) Prior Publication Data

US 2011/0045731 A1 Feb. 24, 2011

(30) Foreign Application Priority Data

Apr. 23, 2008 (JP) ..... 2008-112160

(51) Int. Cl.
*H01T 21/02* (2006.01)
*H01T 13/20* (2006.01)

(52) U.S. Cl.
USPC ..... 445/7; 313/140

(58) Field of Classification Search
USPC ..... 313/140; 445/7
See application file for complete search history.

(56) References Cited

U.S. PATENT DOCUMENTS

| | | | | |
|---|---|---|---|---|
| 5,556,315 | A * | 9/1996 | Kagawa | 445/7 |
| 5,574,329 | A | 11/1996 | Kagawa | |
| 2002/0021066 | A1 | 2/2002 | Kanao | |
| 2002/0055318 | A1 | 5/2002 | Ishiguro et al. | |
| 2002/0167225 | A1 | 11/2002 | Matsubara et al. | |
| 2004/0029480 | A1 * | 2/2004 | Fujita et al. | 445/7 |
| 2004/0061421 | A1 * | 4/2004 | Morita et al. | 313/142 |
| 2009/0302732 | A1 * | 12/2009 | Lykowski | 313/141 |

FOREIGN PATENT DOCUMENTS

| | | | |
|---|---|---|---|
| JP | 7-022154 | A | 1/1995 |
| JP | 7-022156 | A | 1/1995 |
| JP | 8-298178 | A | 11/1996 |
| JP | 9-007734 | A | 1/1997 |
| JP | 2000-208234 | A | 7/2000 |
| JP | 2002-083662 | A | 3/2002 |
| JP | 2002-141154 | A | 5/2002 |
| JP | 2003-017216 | A | 1/2003 |

* cited by examiner

*Primary Examiner* — Anh Mai
*Assistant Examiner* — Michael Santonocito
(74) *Attorney, Agent, or Firm* — Sughrue Mion, PLLC

(57) ABSTRACT

To provide a method of producing a spark plug in which a spark discharge gap with a suitable distance can easily be obtained without bending to deform a ground electrode in a direction in which the ground electrode moves towards or away from a metal tip of a center electrode, in the method of producing a spark plug, when a metal tip (a noble metal tip) 21 is welded to a front end portion 13*a* of a center electrode 13, the metal tip 21 is welded to the front end portion 13*a* of the center electrode 13 after a state is established in which the metal tip 21 alone is positioned in a radial direction where a predetermined spark discharge gap g is formed relative to a distal end portion 14*b* of a ground electrode 14 which is joined to a metal shell 11 at a proximal end portion 14*a* thereof.

11 Claims, 6 Drawing Sheets

METHOD OF PRODUCING A SPARK PLUG

TECHNICAL FIELD

The present invention relates to a method for producing a spark plug which is mounted in a cylinder head of an internal combustion engine such as an engine for use as an ignition source for a fuel mixture that is supplied to a combustion chamber.

BACKGROUND ART

In a conventional spark plug, a cylindrical metal shell, a cylindrical insulator fitted in the metal shell and a circular cylindrical center electrode disposed within the insulator are disposed so that their axes are substantially concentrically in a radial direction. In addition, a pillar-like ground electrode has a construction in which the ground electrode is bent at an intermediate portion thereof so as to be formed into an L-shape and a proximal end portion thereof is welded to be joined to a front end portion of the metal shell, while a distal end portion thereof is disposed to be spaced apart in a radial direction from a metal tip (a noble metal tip) which is welded to be joined to a front end portion of the center electrode. As this occurs, a predetermined spark discharge gap is formed between the noble metal tip of the center electrode and the distal end portion of the ground electrode (for example, refer to Patent Document 1).

Incidentally, for a spark plug in which a distal end portion of a ground electrode is disposed to be spaced apart in a radial direction from a noble metal tip of a center electrode, although it is a general producing method that the center electrode and an insulator are assembled after bending and punching operations are performed in advance on the pillar-like ground electrode which is welded to be joined to a front end portion of a metal shell, this method has had a problem that assembling errors are made, which makes it difficult to obtain an accurate spark discharge gap. Consequently, in the related art, the pillar-like ground electrode is bent and punched in slightly larger dimensions, and after the center electrode and the insulator are assembled, the ground electrode is bent to be deformed in a direction in which the ground electrode moves towards or away from the noble metal tip of the center electrode to thereby adjust the spark discharge gap to a suitable distance.

RELATED ART DOCUMENT

Patent Document

Patent Document 1: JP-A-7-22156

SUMMARY OF THE INVENTION

Problem that the Invention is to Solve

However, in the method in which the ground electrode which is bent and punched in the slightly larger dimensions is bent to be deformed in a direction in which the ground electrode moves towards or away from the noble metal tip of the center electrode to thereby adjust the spark discharge gap, heights of the distal end portions of the ground electrode (in the axial direction of the center electrode) vary, whereby ignitability and spark wear resistance have been affected badly. In addition, in a case of the ground electrode having a noble metal tip, since a welding position of a noble metal tip to the ground electrode tends to vary easily, it has been difficult to obtain a spark discharge gap with a proper gap value between the noble metal tip of the center electrode and the noble metal tip of the ground electrode only by bending to deform the ground electrode in a direction in which the ground electrode moves towards or away from the noble metal tip of the center electrode.

The invention has been made in view of the situations described above, and an object of the invention is to provide a method of producing a spark plug which can easily obtain a spark discharge gap with a proper gap value without bending to deform a ground electrode in a direction in which the ground electrode moves towards or away from a metal tip of a central electrode after the central electrode has been assembled.

Means for Solving the Problem

The above object of the invention is achieved by the following configurations.

(1) A method of producing a spark plug which comprises:

a cylindrical metal shell;

a cylindrical insulator fitted in the metal shell and exposed from a front end portion of the metal shell at a front end portion thereof;

a center electrode disposed within the insulator so as to be exposed from the front end portion of the insulator at its front end portion and comprising a metal tip which is secured to the front end portion through welding; and a ground electrode joined to the metal shell at a proximal end portion thereof and in which a distal end portion thereof is disposed to be spaced apart from the metal tip in a radial direction, thereby a predetermined spark discharge gap is formed between the distal end portion of the ground electrode and the metal tip of the center electrode, wherein when the metal tip is welded to the front end portion of the center electrode, the metal tip is welded to the front end portion of the center electrode after a state is established in which the metal tip is positioned in the radial direction so as to take a position where the metal tip forms the predetermined spark discharge gap relative to the distal end portion of the ground electrode whose proximal end portion is joined to the metal shell.

(2) The spark plug producing method according to (1), wherein the metal tip has a circular cylindrical shape, a plurality of the ground electrodes are disposed in a plurality of positions at predetermined intervals in a circumferential direction of the metal shell, and the diameter of the metal tip is selected so that the predetermined spark discharge gap is formed individually between distal end portions of the plurality of ground electrodes and the metal tip before the metal tip is welded to the front end portion of the center electrode.

(3) The spark plug producing method according to (1) or (2), wherein the metal tip is secured to the front end portion of the center electrode by resistance welding.

(4) The spark plug producing method according to any of claims (1) to (3), wherein the metal tip is formed by joining a Ni alloy tip to one end portion of a noble metal tip by laser welding, and the Ni alloy tip is welded to the front end portion of the center electrode.

(5) The spark plug producing method according to (4), wherein a joining portion of the center electrode to the metal tip is made of a Ni alloy.

(6) The spark plug producing method according to any of claims (1) to (5), wherein a ground electrode side noble metal tip is provided at the distal end portion of the ground electrode so as to form the predetermined spark discharge gap between the metal tip and itself.

According to the configuration described under (1) above, when the metal tip is welded to the front end portion of the center electrode, since the metal tip is welded to the front end portion of the center electrode after the state is established in which the metal tip is positioned in the radial direction so as to take the position where the metal tip forms the predetermined spark discharge gap relative to the distal end portion of the ground electrode whose proximal end portion is joined to the metal shell, the spark discharge gap with the proper gap value can easily be obtained without bending to deform the ground electrode in a direction in which the ground electrode moves towards or away from the metal tip of the central electrode after the central electrode is assembled.

According to the configuration described under (2) above, since the diameter of the metal tip is selected so that the predetermined spark discharge gap is formed individually between the distal end portions of the plurality of ground electrodes and the metal tip before the metal tip is welded to the front end portion of the center electrode, the spark discharge gap with the proper gap value can easily be obtained individually between the distal end portions of the plurality of ground electrodes and the metal tip without bending to deform the plurality of ground electrodes in a direction in which the ground electrodes move towards or away from the metal tip of the central electrode after the central electrode is assembled.

According to the configuration described under (3) above, since the metal tip is secured to the front end portion of the center electrode by resistance welding, not only can the positioning accuracy of the metal tip be increased, but also the securing operation can be eased.

According to the configuration described under (4) above, since the metal tip is formed by joining the Ni alloy tip to the one end portion of the noble metal tip by laser welding and the Ni alloy tip of the metal tip is welded to the front end portion of the center electrode, the separation of the metal tip can be prevented, thereby making it possible to extend the life of the spark plug.

According to the configuration described under (5) above, since the joining portion of the center electrode to the metal tip is made of the Ni alloy, an increase in separation resistance at the joining portions can be realized.

According to the configuration described under (6) above, even in the case of the noble metal tip being provided on the distal end portion of the ground electrode, the spark discharge gap with the proper gap value can easily be obtained between the noble metal tip of the center electrode and the noble tip of the ground electrode without bending to deform the ground electrode in a direction in which the ground electrode moves towards or away from the noble tip of the center electrode after the center electrode and the insulator are assembled.

Advantage of the Invention

According to the invention, the method of producing a spark plug can be provided in which the spark discharge gap with the proper gap value can easily be obtained without bending to deform the ground electrode in a direction in which the ground electrode moves towards or away from the metal tip of the center electrode after the center electrode and the insulator have been assembled.

MODE FOR CARRYING OUT THE INVENTION

Hereinafter, preferred embodiments of spark plug producing methods according to the invention will be described by reference to the drawings.

Figure 1:
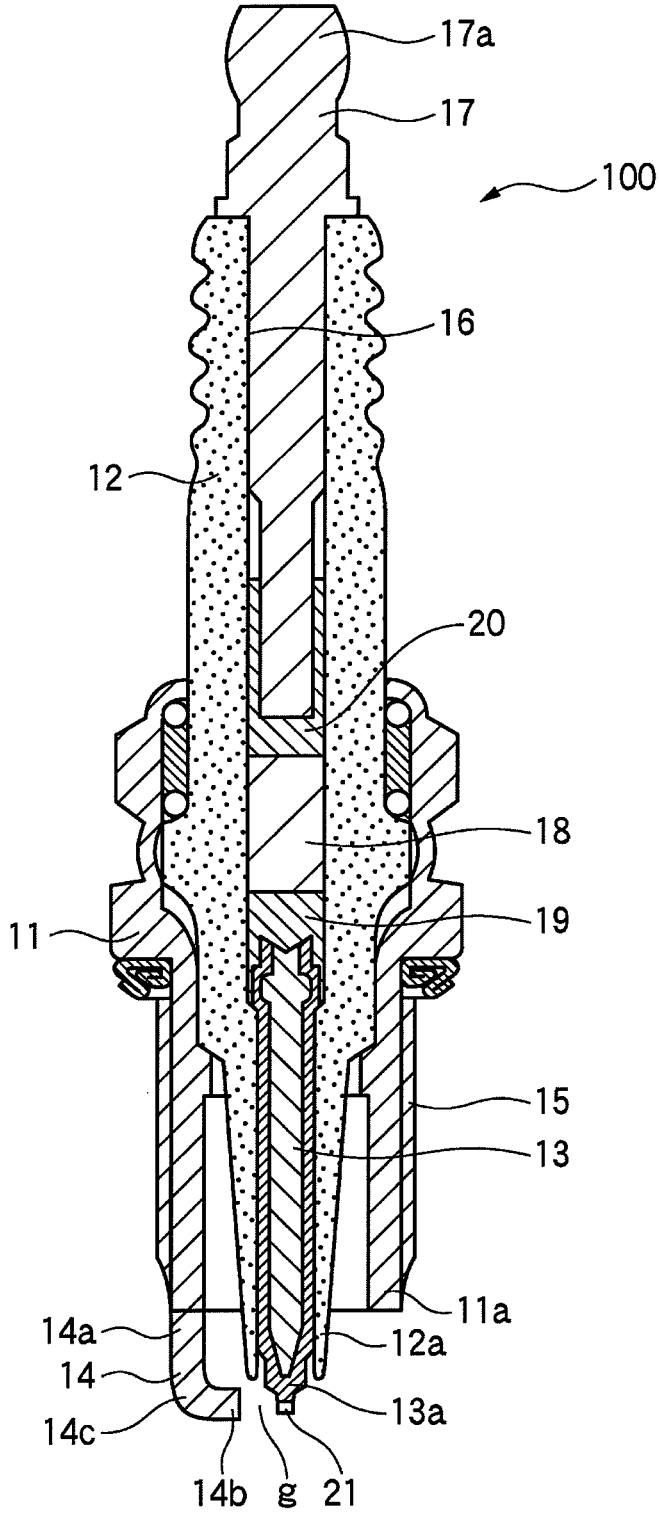
FIG. 1 is a sectional view showing a spark plug which is produced by a spark plug producing method according to the invention.

FIG. 1 is a sectional view showing a spark plug which is produced by a spark plug producing method according to the invention.

A spark plug 100 shown in FIG. 1 is configured to include mainly a cylindrical metal shell 11, a cylindrical insulator 12 which is fitted in the metal shell 11 and is exposed at its front end portion 12*a* from a front end portion 11*a* of the metal shell 11, a center electrode 13 which is disposed within the insulator 12 so that its front end portion 13*a* is exposed from the front end portion 12*a* of the insulator and in which a circular cylindrical metal tip (a noble metal tip) 21 is secured to the front end portion 13*a* by welding, and a ground electrode 14 which is welded to be joined to the front end portion 11*a* of the metal shell 11 at its proximal end portion 14*a* and whose distal end portion 14*b* is disposed to be spaced apart from the noble metal tip 21 of the center electrode 13 so as to face the noble metal tip 21 in a radial direction.

In the following description, a side where the center electrode 13 is disposed in an axial direction of the metal shell 11 will be described as a front side, and an opposite side thereto (a side where a terminal metal base 17 is disposed) will be described as a rear side.

The metal shell 11 is formed of carbon steel or the like, and a mounting thread portion 15 for the metal shell 11 to be mounted in a cylinder head of an internal combustion engine, for example, is formed on an outer circumferential surface of the metal shell 11. A terminal metal base 17 is inserted to be fixed at a rear side (an upper side in the figure) end portion of a through hole 16 formed axially in the insulator 12 which is made of a ceramic calcined material such as alumina with its rear end portion 17*a* exposed, and the center electrode 13 is inserted to be fixed at a front side (a lower side in the figure) end portion of the through hole 16 with the front end portion 13*a* exposed.

A resistor 18 is disposed at an intermediate portion between the terminal metal base 17 and the center electrode 13 within the through hole 16, and conductive glass seal layers 19, 20 are disposed at both axial end portions of the resistor 18. Namely, the center electrode 13 and the terminal metal base 17 are connected electrically via the resistor 18 and the conductive glass seal layers 19, 20. These conductive glass seal layers 19, 20 and the resistor 18 make up a conductive bonded layer.

Alternately, the resistor 18 may be omitted, so that the terminal metal base 17 and the center electrode 13 are joined together by a single conductive glass seal layer.

The center electrode 13 is formed into a circular cylindrical shape of a Ni alloy which has superior heat resistance and corrosion resistance such as Inconel (trade name), and a circular cylindrical noble metal tip 21 is secured to the front end portion 13*a* of the center electrode 13 through welding.

The ground electrode 14 is formed into a prism-like shape of a Ni alloy which has superior heat resistance and corrosion resistance, and the proximal end portion 14*a* is joined to the front end portion 11*a* of the metal shell 11 through welding. The ground electrode 14 has a bent portion 14*c* at an intermediate portion thereof so as to be bent into a substantially L-shape, and the distal end portion 14*b* is disposed spaced apart from the noble metal tip 21 of the center electrode 13 so as to face the noble metal tip 21 in a radial direction.

By this, a spark discharge gap g is formed between the noble metal tip 21 of the center electrode 13 and the distal end portion 14*b* of the ground electrode 14. A distance of the spark discharge gap g is set to be approximately 0.9 mm, for example. By a high voltage being applied between the distal end portion 14*b* of the ground electrode 14 and the noble metal tip 21 of the center electrode 13 in this state, a spark discharge is caused to be generated in the spark discharge gap g, whereby the spark plug 100 of this embodiment is allowed to function as an ignition source.

As a noble metal that is used for the noble metal tip 21 of the center electrode 13, a material having high oxidation resistance and superior spark wear resistance is used which includes an alloy which is made up of iridium (Ir) as a main constituent with at least one of additional matters added thereto which include Pt, Rh, Ni, W, Pd, Ru, Re, Al, $Al_2O_3$, Y, $Y_2O_3$ and the like and an alloy which is made up of platinum (Pt) as a main constituent with at least one of additional matters added thereto which include Ir, Rh, Ni, W, Pd, Ru, Re and the like.

According to the invention, not only noble metals but also other metals (for example, a Ni alloy which is used for the center electrode 13) can be used for the tip 21.

Next, referring to FIGS. 2 to 4, a first embodiment of a method for producing the spark plug 100 according to the invention will be described.

Figure 2B:
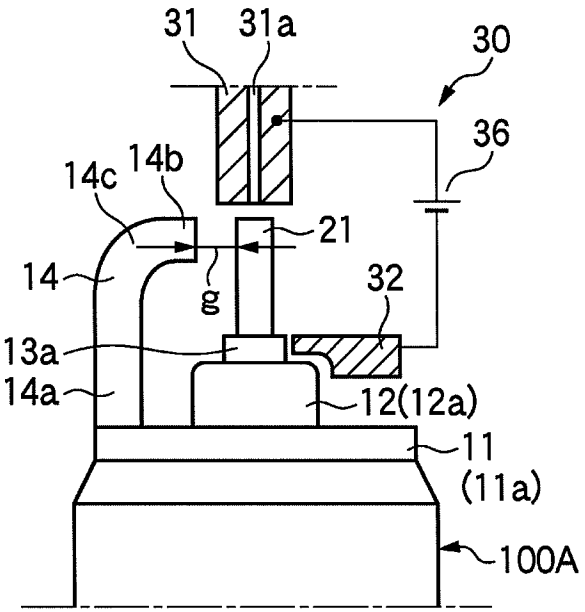
FIGS. 2A and 2B are process diagrams which explain a first embodiment of a spark plug producing method according to the invention.
Figure 2A:
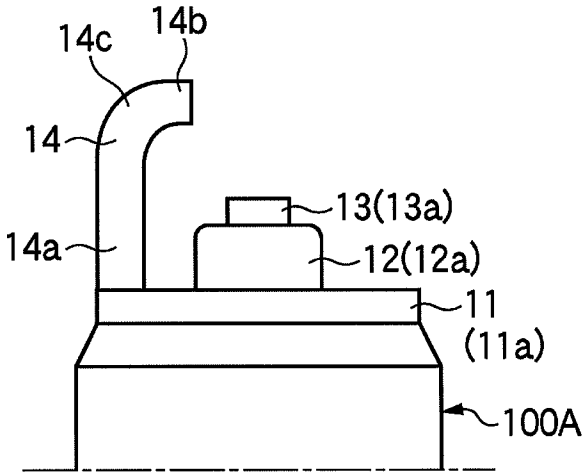
Figure 3:
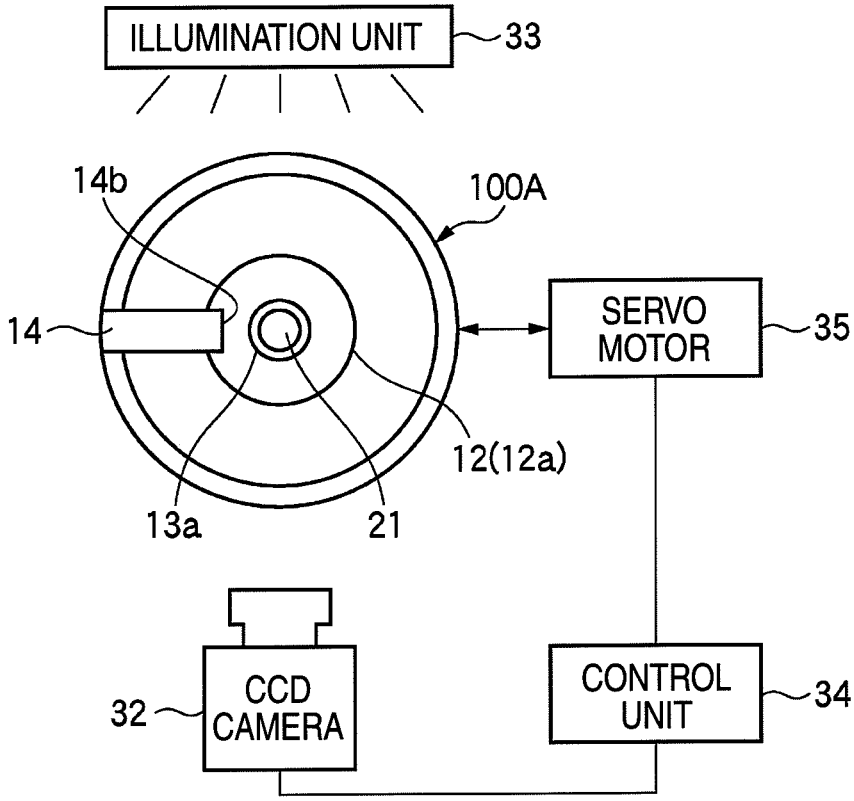
FIG. 3 is an explanatory diagram which explains an example of a noble metal tip positioning method.
Figure 4:
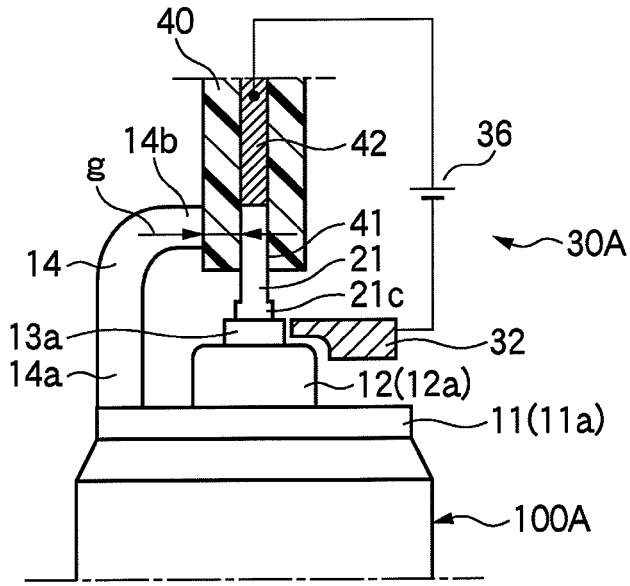
FIG. 4 is an explanatory diagram which explains another example of a noble metal tip positioning method.

FIGS. 2A, 2B are process diagrams which explain a first embodiment of a spark plug producing method according to the invention, FIG. 3 is an explanatory diagram which explains one example of a noble metal tip positioning method, and FIG. 4 is an explanatory diagram which explains another example of a noble metal tip positioning method.

In the method for producing the spark plug 100 of this embodiment, as is shown in FIG. 2A, a bending operation and a punching operation are performed in advance on the pillar-like ground electrode which is welded to be joined to the front end portion 11*a* of the metal shell 11 and the distal end portion 14*b* thereof, respectively. The spark plug 100 (hereinafter, referred to as the spark plug main body 100A), in which the noble metal tip 21 has not yet been welded to be joined to a front end face of the front end portion 13*a* of the center electrode 13, is held on an XY stage, not shown, for example. As is shown in FIG. 2(*b*), an anode side member 31 of a resistance welding machine 30 is disposed axially movably so as to face the front end face of the front end portion 13*a* of the center electrode 13 of the plug main body 100A held on the XY stage, and a cathode side member 32 of the resistance welding machine 30 is disposed kept in contact with the front end portion 13*a* of the center electrode 13.

The anode side member 31 of the resistance welding machine 30 is positioned in a substantially coaxial position with the front end portion 13*a* of the center electrode by the XY stage, and an attracting hole 31*a* is provided in an interior of the anode side member for attracting to hold the noble metal tip 21. This anode side member 31 is caused to move in an axial direction so as to approach the front end face of the front end portion 13*a* of the center electrode 13 with the noble metal tip 21 alone attracted to be held by the attracting hole 31*a* of the anode side member 31, and in this state, for example, as is shown in FIG. 3, images of the distal end portion 14*b* of the ground electrode 14 and the noble metal tip 21 are sensed from a radially outward direction by a CCD camera 32 or the like.

As this occurs, a light illumination device 33 for illuminating light towards the distal end portion 14*b* of the ground electrode 14 and the noble metal tip 21 is disposed on an opposite side of the plug main body 100A to the side where the CCD camera 32 is disposed.

Here, the image data sensed by the CCD camera 32 is image processed by an image processing part of a control unit 34 to thereby detect a gap between the front end portion 14*b* of the ground electrode 14 and the noble metal tip 21. Then, the control unit 34 controls a drive system (for example, a servo motor) 35 of the XY stage so as to cause the plug main body 100A to move towards or away from the noble metal tip 21 attracted to be held by the attracting hole 31*a* of the anode side member 31 so that the detected value becomes a predetermined spark discharge gap g. By this, a state is established in which the noble metal tip 21 alone is positioned in a radial position where the noble metal tip 21 forms the predetermined spark discharge gap g relative to the distal end portion 14*b* of the ground electrode 14.

After the noble metal tip 21 is positioned in the way described above, the anode side member 31, which is attracting to hold the noble metal tip 21, is caused to move further in the axial direction so as to approach the front end face of the front end portion 13*a* of the center electrode 13, whereby the noble metal tip 21 is brought into abutment with the front end face of the front end portion 13*a* of the center electrode. By a power supply 36 is made in this state (refer to FIG. 2B), the noble metal tip 21 is secured to the front end face of the front end portion 13*a* of the center electrode 13 by welding. Thereafter, the attraction of the noble metal tip 21 by the anode side member 31 is released, and the resistance welding machine 30 is withdrawn. Then, by the spark plug 100 in which the noble metal tip 21 is secured to the plug main body 100A being removed from the XY stage, the production of the spark plug 100 is completed.

In this embodiment, while the positioning of the noble metal tip 21 is implemented by making use of the sensed data of the gap by the CCD camera 32 or the like, the positioning method of the noble metal tip 21 is not limited thereto. For example, as is shown in FIG. 4, the positioning of the noble metal tip 21 may be implemented by the use of a positioning sleeve 40 which is made up of an insulator.

In this case, as is shown in FIG. 4, a holding hole 41 is provided in an end portion of the positioning sleeve 40 so that a front end portion of the noble metal tip 21 alone is fitted to be held therein. In addition, an anode side member 42 of a resistance welding machine 30A which is to be brought into contact with the noble metal tip 21 which is held in the holding hole 41 is fitted in an interior of the positioning sleeve 40.

In the example shown in FIG. 4, the anode side member 42 is made solid, and a flange 21*c* is formed at a proximal end portion of the noble metal tip 21.

The flange 21*c* of the noble metal tip 21 which is held in the holding hole 41 of the positioning sleeve 40 is brought into abutment with the front end face of the front end portion 13*a* of the center electrode 13 of the plug main body 100A which is supported on a supporting device, not shown, and an outer circumferential portion of the positioning sleeve 40 is brought into abutment with the distal end portion 14*b* of the ground electrode 14, whereby the noble metal tip 21 is positioned in a radial position where the gap between the distal end portion 14*b* of the ground electrode 14 and the noble metal tip 21 becomes the predetermined spark discharge gap g.

By a power supply 36 of the resistance welding machine 30A being made after the noble metal tip 21 is so positioned, the noble metal tip 21 is secured to the front end face of the front end portion of the center electrode 13 by welding. Thereafter, the resistance welding machine 30A is withdrawn together with the positioning sleeve 40 and the spark plug 100 in which the noble metal tip 21 is secured to the plug main body 100A is removed from a supporting unit, whereby the production of the spark plug 100 is completed.

As has been described heretofore, according to the method for producing the spark plug 100 of the embodiment, since when the noble metal tip 21 is welded to the front end portion 13*a* of the center electrode, the noble metal tip 21 is welded to the front end portion 13*a* of the center electrode 13 after the noble metal tip 21 alone is positioned in the radial position where the predetermined spark discharge gap g is formed relative to the distal end portion 14*b* of the ground electrode 14 which is joined to the front end portion 11*a* of the metal shell 11 at the proximal end portion 14*a* thereof, the spark discharge gap g with a proper gap value can easily be obtained without bending to deform the ground electrode 14 in a direction in which the ground electrode 14 moves towards or away from the noble metal tip 21 of the center electrode after the center electrode is assembled.

Additionally, since the noble metal tip 21 is secured to the front end portion 13*a* of the center electrode 13 by resistance welding, not only can the positioning accuracy of the noble metal tip 21 be increased, but also the securing operation can be eased.

Next, referring to FIG. 5, a second embodiment of a spark plug producing method according to the invention will be described.

Figure 5A:
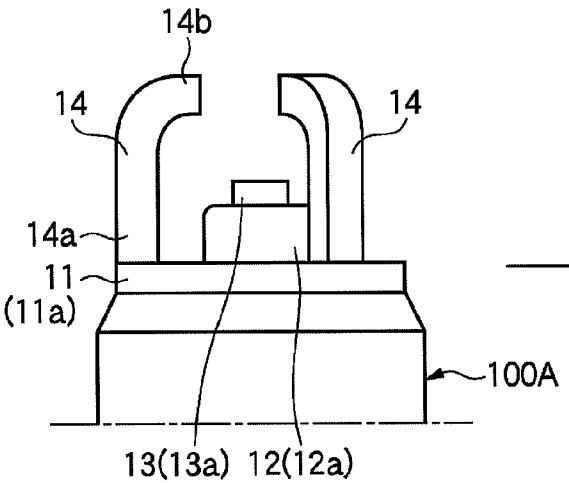
FIGS. 5A, 5B and 5C are diagrams which explain a second embodiment of a spark plug producing method according to the invention.
Figure 5B:
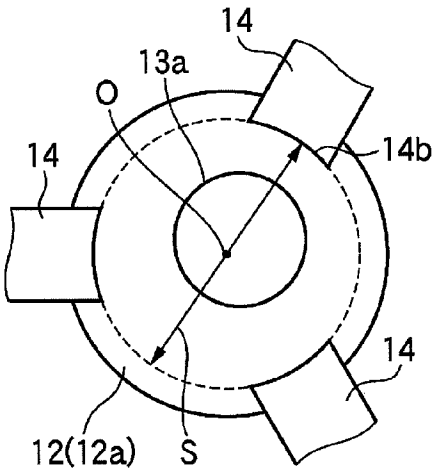
Figure 5C:
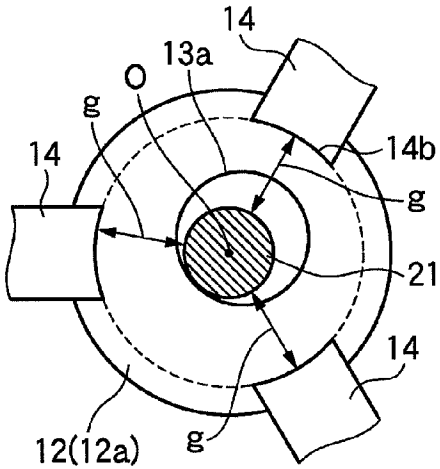

FIGS. 5A, 5B, 5C are diagrams which explain a second embodiment of a spark plug producing method according to the invention.

Like reference numerals will be given to like or corresponding portions to those described in the first embodiment.

In this embodiment, three ground electrodes 14 are welded to be joined to a front end portion 11*a* of a metal shell 11 at substantially equal intervals. As with the first embodiment, bending operations and punching operations of distal end portions 14*b* are performed on the three ground electrodes 14 in advance. A plug main body 100A having the three ground electrodes 14 is supported on a supporting unit, not shown, and an image of an end portion of the plug main body 100A which lies on a side thereof where the three ground electrodes 14 are provided is sensed by a CCD camera, not shown, like the one described in FIG. 3 from above in an axial direction, the image data so sensed being image processed by an image processing unit of a control unit, not shown. In this image processing, central coordinates O of a noble metal tip 21 is detected from a punching diameter S of distal end portions 14*b* of the three ground electrodes 14, and a diameter (a length of a straight line passing from side to side through the center) of the circular cylindrical noble metal tip 21 is calculated based on respective values of the punching diameter S, the central coordinates O and a spark discharge gap g so that the spark discharge gap g is formed in a gap between the distal end portions 14 of the three ground electrodes 14 and the noble metal tip 21.

Before the noble metal tip 21 is welded to a front end portion 13*a* of a center electrode 13, a noble metal tip 21 having the calculated diameter is selected, and the noble metal tip 21 so selected based on the calculated diameter is placed on a front end face of the front end portion 13*a* of the center electrode 13 by a manipulator or a drive system of an XY stage which is controlled by a control unit so that the center of the noble metal tip 21 coincides with the central coordinates O. By this, when the noble metal tip 21 is welded to the front end portion 13*a* of the center electrode 13, a state is established in which the noble metal tip 21 alone is positioned in a radial position where the predetermined discharge gap g is formed relative to the distal end portions 14*b* of the three ground electrodes 14.

When selecting the noble metal tip 21 having the calculated diameter, a plurality of noble metal tips 21 having different diameters may be prepared in advance for selection of the noble metal tip 21 having the calculated diameter therefrom. Alternately, the noble metal tip 21 may be worked to have the calculated diameter every time a diameter is calculated.

By a power supply of a resistance welding machine, not shown, being made after the noble metal tip 21 is so positioned, the noble metal tip 21 is secured to the front end face of the front end portion 13*a* of the noble metal tip 21 by welding. Thereafter, the resistance welding machine is withdrawn, and the spark plug 100 in which the noble metal tip 21 is secured to the plug main body 100A is removed from the supporting unit, whereby the production of the spark plug 100 is completed.

As has been described heretofore, according to the method for producing the spark plug 100 of this embodiment, since the noble metal tip 21 having the optimum diameter to form the predetermined spark discharge gap g individually between the distal end portions 14*b* of the three ground electrodes 14 and the noble metal tip 21 is selected before the noble metal tip 21 is welded to the front end portion 13*a* of the center electrode 13, the spark discharge gap with a proper gap value can easily be obtained between the distal end portions 14*b* of the three ground electrodes 14 without bending to deform the three ground electrodes 14 in a direction in which the ground electrodes 14 move towards or away from the noble metal tip 21 on the center electrode 13 after the center electrode 13 is assembled.

Next, referring to FIG. 6, a third embodiment of a spark plug producing method according to the invention will be described.

Figure 6A:
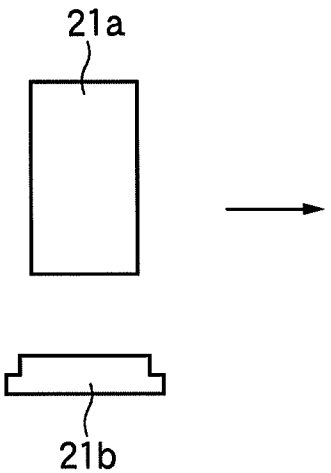
FIGS. 6A, 6B and 6C are diagrams which explain a third embodiment of a spark plug producing method according to the invention.
Figure 6B:
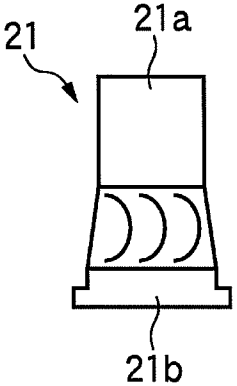
Figure 6C:
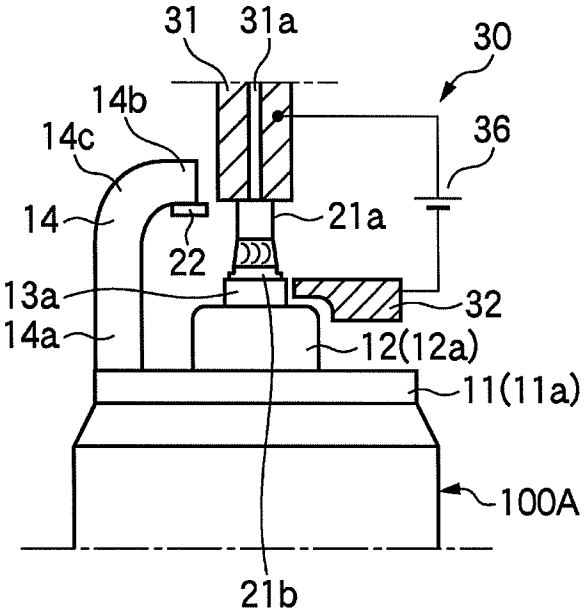

FIGS. 6A, 6B, 6C are diagrams which explain a third embodiment of a spark plug producing method according to the invention.

Like reference numerals will be given to like or corresponding portions to those described in the first embodiment.

In this embodiment, as is shown in FIGS. 6A and 6B, a metal tip 21 is prepared in which a Ni alloy tip 21*b* is welded to be joined in advance to one end portion of a noble metal tip 21*a* such as an Ir alloy (for example, Ir-20Rh) by laser welding, and the Ni alloy tip (for example INC601) 21*b* of the metal tip 21 is welded to a front end face of a front end portion 13*a* of a center electrode 13 by, for example, the resistance welding machine 30 used in the first embodiment. In this embodiment, a noble metal tip (for example, Pt-10Ni) 22 is welded to be joined to a distal end portion 14*b* of a ground electrode 14 in a position which faces the noble metal tip 21*a* in a radial direction.

As a positioning method of the metal tip 21, the same method as that used in the first embodiment can be used. As this occurs, in the positioning method described in FIG. 3, an image of a gap between the metal tip 21 and the noble metal tip 22 of the ground electrode 14 is sensed by the CCD camera 32, and in the positioning method described in FIG. 4, an outer circumferential portion of the positioning sleeve 40 is brought into abutment with the noble metal tip 22 of the ground electrode 14.

As has been described heretofore, according to the method for producing the spark plug 100 of the embodiment, also in the case of the noble metal tip 22 being provided at the distal end portion 14*b* of the ground electrode 14 which is welded to be joined to a front end portion 11*a* of a metal shell 11 at a proximal end portion 14*a* thereof, since the metal tip 21 is welded to the front end portion 13*a* of the center electrode 13 after a state is established in which the metal tip 21 alone is positioned in a radial position where a predetermined spark discharge gap is formed relative to the noble metal tip 22, a spark discharge gap g with a proper gap value can easily be obtained without bending to deform the ground electrode 14 in a direction in which the ground electrode 14 moves towards or away from the metal tip 21 of the center electrode 13.

Since the Ni alloy tip 21*b* of the metal tip 21 and the front end portion 13*a* (the joining portion to the metal tip 21) of the center electrode 13 are made of the Ni alloys which are materials having the same thermal expansion coefficient, the separation of the metal tip 21 can be prevented, so as to extend the life of the spark plug 100.

The invention is not limited to the embodiments described heretofore but can be modified or improved as required. For example, in the embodiments, while the distal end portion 14*b* (or the noble metal tip 22) of the ground electrode 14 is described as being disposed spaced apart from the metal tip (or the noble metal tip) 21 of the center electrode 13 in the position where the distal end portion 14*b* faces the metal tip 21 in the radial direction, the invention is not limited thereto, and hence, the invention can also, of course, be applied to a case where the distal end portion 14*b* (or the noble metal tip 22) of the ground electrode 14 is disposed spaced apart in the radial direction from the metal tip (the noble metal tip) 21 of the center electrode 13 with the distal end portion 14*b* offset in the axial direction relative to the metal tip 21.

In the embodiments described heretofore, while the metal tip (the noble metal tip) 21 is secured to the front end face of the front end portion 13*a* of the center electrode 13 by resistance welding, the invention is not limited thereto. The metal tip (the noble metal tip) 21 may be secured to the front end face of the front end portion 13*a* of the center electrode 13 by laser welding. The securing strength between the metal tip (the noble metal tip) 21 and the front end portion 13*a* of the center electrode 13 can be increased by adopting laser welding. In addition, in a laser welding machine, since electrode members for causing electric current to flow to the metal tip (the noble metal tip) 21 and the center electrode 13 can be omitted when compared with the resistance welding machine, the configuration of the welding machine can be simplified, and hence, the producing costs can be reduced. In order to increase the securing strength between the metal tip (the noble metal tip) 21 and the front end portion 13*a* of the center electrode 13 while the positioning accuracy of the metal tip (the noble metal tip) 21 is ensured, both the front end face of the front end portion 13*a* of the center electrode 13 and the metal tip (the noble metal tip) 21 may be secured to each other by laser welding after they are temporarily secured to each other by resistance welding.

While the invention has been described in detail and by reference to the specific embodiments, it is obvious to those skilled in the art to which the invention pertains that various alterations or modifications can be made thereto without departing from the spirit and scope of the invention.

This patent application is based on Japanese Patent Application (No. 2008-12160) filed on Apr. 23, 2008, the entire contents of which are incorporated herein by reference.

DESCRIPTION OF REFERENCE NUMERALS AND CHARACTER

11 metal shell; 11*a* front end portion of metal shell; 12 insulator; 12*a* front end portion of insulator; 13 center electrode; 13*a* front end portion of center electrode; 14 ground electrode; 14*a* proximal end portion of ground electrode; 14*b* distal end portion of ground electrode; 21 metal tip (noble metal tip); 21*a* noble metal tip; 21*b* Ni alloy tip; 21*c* flange; 22 noble metal tip; 100 spark plug; g spark discharge gap.

The invention claimed is:

1. A method of producing a spark plug which comprises:

a cylindrical metal shell;

a cylindrical insulator fitted in the metal shell and including a front end portion exposed from a front end portion of the metal shell;

a center electrode which is disposed within the insulator and which includes a front end portion exposed from the front end portion of the insulator and a metal tip which is secured to the front end portion of the center electrode through welding; and a ground electrode which includes a proximal end portion joined to the metal shell and a distal end portion disposed to be spaced apart from the metal tip in a radial direction in such a manner that a predetermined spark discharge gap is formed between the distal end portion of the ground electrode and the metal tip of the center electrode, the method comprising:

welding a ground electrode tip to a distal end portion of the ground electrode in a position which faces the center electrode;

thereafter, positioning the metal tip on a predetermined position of the front end portion of the center electrode in a radial direction relative to a center axis of the center electrode, thereby forming the predetermined spark discharge gap between the metal tip and the distal end portion of the ground electrode whose proximal end portion is previously joined to the metal shell; and then welding the metal tip to the front end portion of the center electrode after positioning step.

2. The method according to claim 1, wherein the metal tip has a circular cylindrical shape, a plurality of the ground electrodes are disposed in a plurality of positions at predetermined intervals in a circumferential direction of the metal shell, and the method comprises selecting a diameter of the metal tip is selected so that the predetermined spark discharge gap is formed individually between distal end portions of the plurality of ground electrodes and the metal tip before the positioning step.

3. The method according to claim 1, wherein the welding step includes resistance welding for securing the metal tip to the front end portion of the center electrode.

4. The method according to claim 1, wherein the metal tip is formed by joining a Ni alloy tip to one end portion of a noble metal tip by laser welding, and in the welding step, the Ni alloy tip is welded to the front end portion of the center electrode.

5. The method according to claim 4, wherein a joining portion of the center electrode to the metal tip is made of a Ni alloy.

6. The method according to claim 1, wherein a ground electrode side noble metal tip is provided at the distal end portion of the ground electrode so as to form the predetermined spark discharge gap between the metal tip and the ground electrode side noble metal tip.

7. The method according to claim 1, wherein prior to the positioning step, the method further comprises welding the proximal end portion of the ground electrode to the metal shell.

8. The method according to claim 7, wherein following the step of welding the proximal end portion of the ground electrode to the metal shell, the distal end portion of the ground electrode is bent in the direction of the center electrode so as to be spaced apart therefrom.

9. The method according to claim 1, wherein the positioning step includes imaging the position of the metal tip with a camera and processing the image to detect the predetermined spark discharge gap.

10. The method according to claim 9, wherein prior to the imaging step, the distal end portion of the ground electrode and the metal tip are illuminated.

11. The method according to claim 1, wherein the ground electrode tip is welded to a rear side face of the distal end portion of the ground electrode.

* * * * *